US011358291B2

(12) United States Patent
Buerk

(10) Patent No.: US 11,358,291 B2
(45) Date of Patent: Jun. 14, 2022

(54) OUT-THE-FRONT KNIFE WITH LOW FRICTION BUTTON

(71) Applicant: Andrew Buerk, Smethport, PA (US)

(72) Inventor: Andrew Buerk, Smethport, PA (US)

( * ) Notice: Subject to any disclaimer, the term of this patent is extended or adjusted under 35 U.S.C. 154(b) by 0 days.

(21) Appl. No.: 17/053,962

(22) PCT Filed: May 8, 2019

(86) PCT No.: PCT/US2019/031344
§ 371 (c)(1),
(2) Date: Nov. 9, 2020

(87) PCT Pub. No.: WO2019/217569
PCT Pub. Date: Nov. 14, 2019

(65) Prior Publication Data

US 2021/0268671 A1 Sep. 2, 2021

Related U.S. Application Data

(60) Provisional application No. 62/668,557, filed on May 8, 2018.

(51) Int. Cl.
*B26B 1/08* (2006.01)

(52) U.S. Cl.
CPC ..... *B26B 1/08* (2013.01)

(58) Field of Classification Search
CPC ..... B26B 10/08; B26B 1/10; A47B 31/00; H01R 13/28
USPC ..... 30/162–163, 151
See application file for complete search history.

(56) References Cited

U.S. PATENT DOCUMENTS 1,556,547 A * 10/1925 Ricard ..... B23D 51/02 30/392
3,439,426 A * 4/1969 Wilson ..... C03B 33/12 33/32.2
4,197,649 A * 4/1980 Flinn ..... B43L 7/00 33/32.1
4,335,512 A * 6/1982 Sheps ..... B23Q 9/0014 30/376
2008/0222897 A1* 9/2008 Marfione ..... B26B 1/08 30/162
2014/0165409 A1* 6/2014 Scimone ..... B26B 5/003 30/162
2017/0057102 A1* 3/2017 Watanabe ..... B26B 5/003

* cited by examiner

*Primary Examiner* — Nhat Chieu Q Do
(74) *Attorney, Agent, or Firm* — Jonathan M. D'Silva; MMI Intellectual Property

(57) ABSTRACT

An out-the-front knife comprises a handle having a blade channel, a slider channel, and an opening. A blade in the blade channel is configured to travel along the blade channel. A firing mechanism in the slider channel is configured to extend the blade to an open position and retract the blade to a closed position. The firing mechanism comprises a slider that has a nub that fits into the opening and extends outside the handle. A button has a nub opening that receives the nub and at least one bearing opening. A friction plate is interposed between the button and the handle. At least one bearing is inserted into the at least one bearing opening. The at least one bearing supports the button on the friction plate.

8 Claims, 3 Drawing Sheets

OUT-THE-FRONT KNIFE WITH LOW FRICTION BUTTON

BACKGROUND

An out-the-front knife, also known as an OTF knife, a sliding knife, or a telescoping knife is a pocketknife with a blade that opens and closes through a hole in one end of the handle. This contrasts with folding knives or knives with fixed blades. Out-the-front knives also exist in many varieties, including manually operated in which the opening and closing of the knife is manually actuated, single action automatic knives in which the blade is opened automatically but manually retracted, and double action automatic knives in which both the opening and the closing of the knife is automatic. OTF knives that are automatic typically have a button that is actuated by the user to extend and/or retract the blade. These buttons typically slide directly on the handle material that creates high friction and wear which make the knives more difficult to operate and lowers the life of the knife. What is presented is an improved low friction button for an out-the-front knife that overcomes some of the deficiencies of prior art configurations

SUMMARY

What is presented is an out-the-front knife comprising a handle having a blade channel, a slider channel, and an opening. A blade in the blade channel, the blade configured to travel along the blade channel when the blade is retracted. The blade is secured within the handle and is housed completely within the handle and when the blade is extended, the blade is secured within the handle and extends outwardly therefrom. A firing mechanism in the slider channel is configured to extend the blade to an open position and retract the blade to a closed position. The firing mechanism comprises a slider that has a nub that fits into the opening and extends outside the handle. A button has a nub opening that receives the nub and at least one bearing opening. A friction plate is interposed between the button and the handle. At least one bearing is inserted into the at least one bearing opening. The at least one bearing supports the button on the friction plate.

In some embodiments, the button has three bearing openings. In various embodiments, the at least one bearing is a sphere, a cylinder, or a disk. In various embodiments, the at least one bearing is pressed into the bearing opening, or are free rolling within the bearing opening, or are fixed to the bearing opening.

Those skilled in the art will realize that this invention is capable of embodiments that are different from those shown and that details of the devices and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
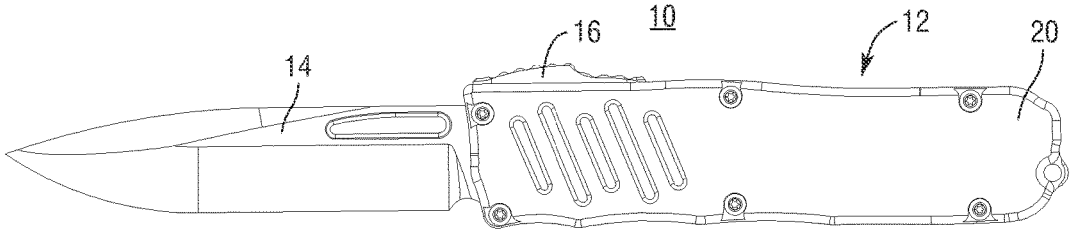
FIG. 1 is a side view of the out-the-front knife.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

Automatic out-the-front knives are typically actuated with a button that a user pushes forward to overcome the spring pressure of the firing mechanism of the knife that extends the blade of the knife out of the handle of the knife with enough force to lock it into the extended position. The buttons for double action out-the-front knives also work in the opposite direction to allow a user to push the same button backwards to overcome spring pressure of the firing mechanism to withdraw the blade back into the handle of the knife with sufficient force to lock it in the closed position. Typically, the button sits on the handle of the knife. The handle is typically made of material that has some aesthetic appeal. However, the handle is not made of low-friction material and it is prone to wear. In fact, the button and handle interface is a weakness of out-the-front knives.

The buttons of automatic out-the-front knives can be hard to actuate because in addition to having to overcome the spring force of the firing mechanism, the friction between the button and the handle makes the moving the button against the handle difficult. Wear between the button and the handle is a common problem.

The out-the-front knife 10 shown in FIG. 1 addresses many of the drawbacks of the prior art. The out-the-front knife 10 comprises a handle 12 and a blade 14. A button 16 located on the handle 12 actuates the operation of the out-the-front knife 10. In the embodiments shown, the button 16, is located at the top of the handle 12, but it could be located elsewhere on the handle 12, such as on the side or on the bottom.

As will be discussed herein, from the open position shown in FIG. 1, pulling backwards on the button 16 along the length available for it to travel actuates the internal mechanisms of the out-the-front knife 10 causing the blade 14 to fully retract into the handle 12. Pushing forwards on the button 16 along the length available for it to travel actuates the internal mechanisms of the out-the-front knife 10 causing the blade 14 to fully extend out of the handle 12.

Figure 2:
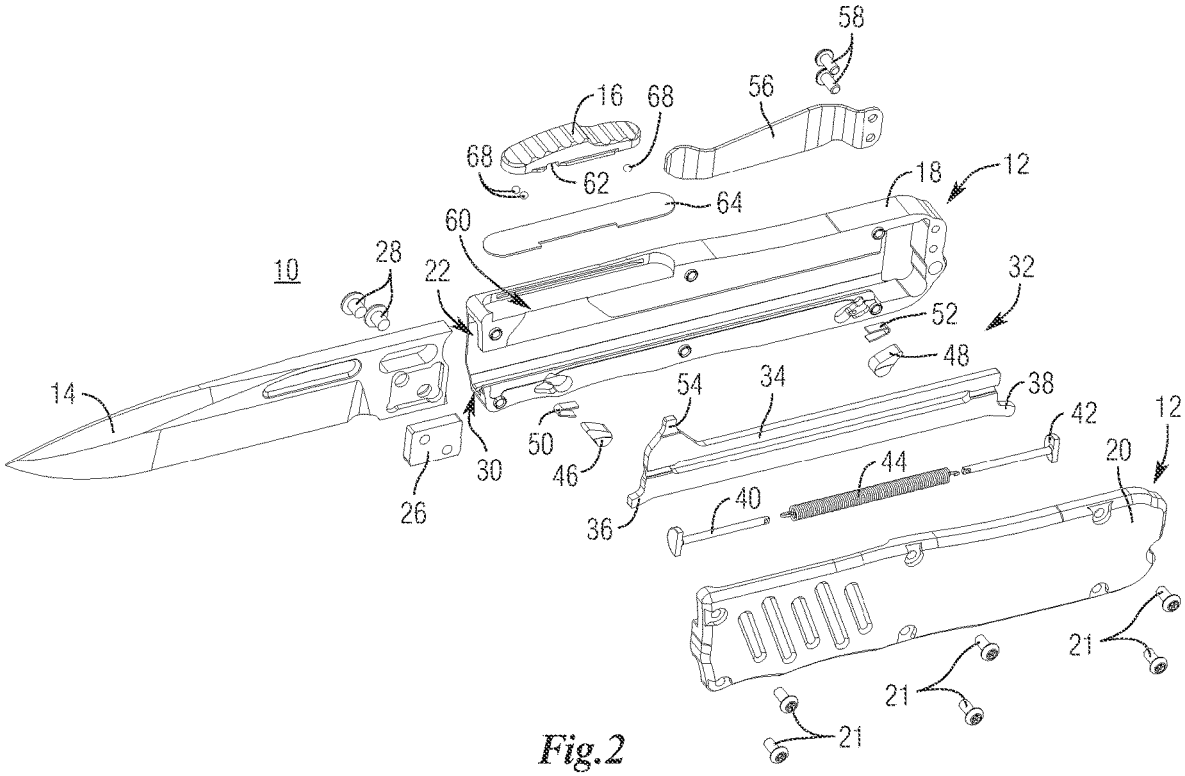
FIG. 2 is an exploded view of the out-the-front knife of FIG. 1.
Figure 3:
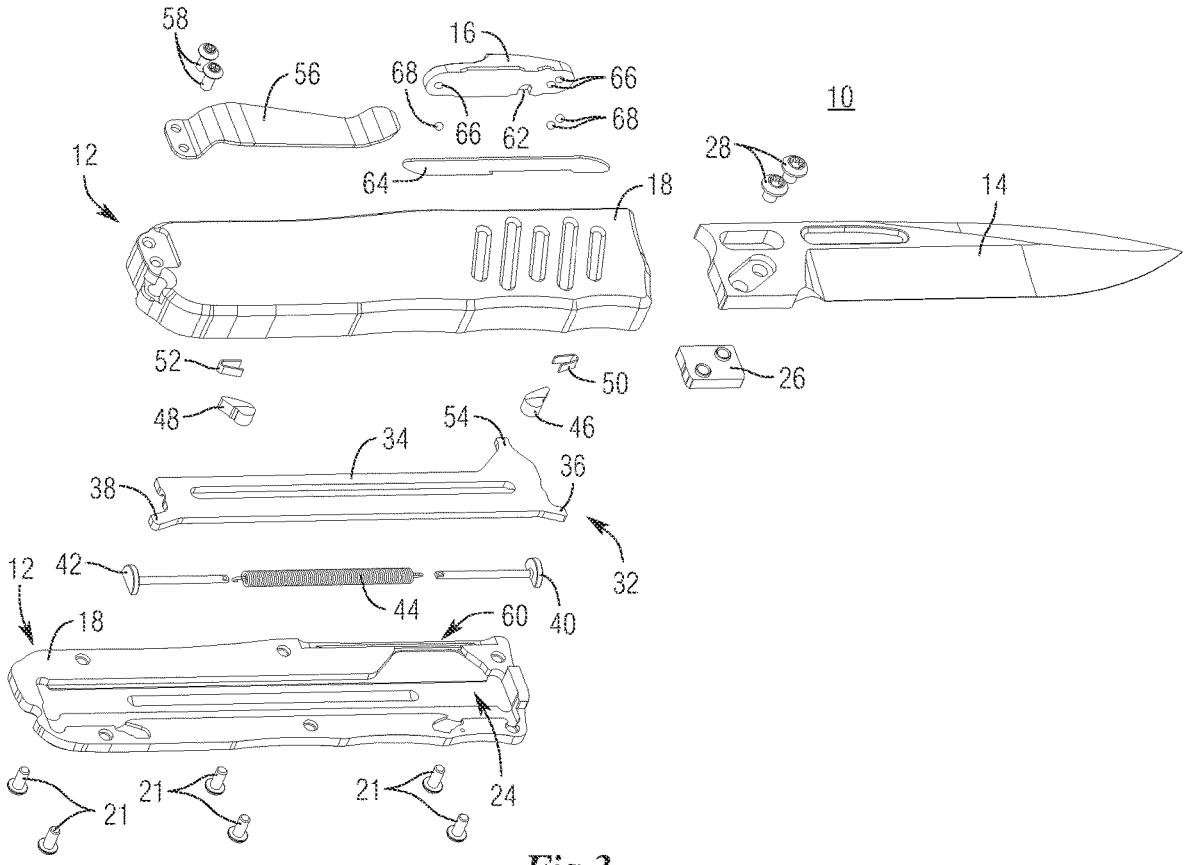
FIG. 3 is another exploded view of the out-the-front knife of FIG. 1 showing the opposite side of the knife.

As best understood by comparing FIGS. 1 through 3, the handle 12 comprises a frame 18 and a cover 20 that are secured to each other with screws 21. It will be understood that other attachment devices may be used to secure the cover 18 to the frame 20, such as pins, bolts, rivets, glue, a compression fit, etc. A blade channel 22 is formed within the frame 18 and a slider channel 24 is formed within the cover 20. The blade 14 travels through the blade channel 22 when it moves into and out of the handle 12. When the blade 14 is retracted it is secured within the handle 12 and is housed completely within the handle 12 and when the blade 14 is extended it is secured within the handle 12 and extends outwardly therefrom.

A blade insert 26 is mounted to an opening in the blade 14 that is sized to receive it. In the embodiment shown, the blade insert 26 is mounted to the blade 14 with screws 28. However, it is understood that other attachment devices may be used such as pins, rivets, bolts, nuts, etc. The blade insert 26 could also be glued, soldered, or compression fit into the blade 26. While the blade insert 26 is a separate piece from the blade 14, it is possible for the blade insert 26 to be a formed directly as an integral part of the blade 14.

An insert channel 30 is interposed between the blade channel 22 and the slider channel 24. The insert channel 30 is sized to fit the blade insert 26. As the blade 14 travels through the blade channel 22, the blade insert 26 travels through the insert channel 30.

A firing mechanism 32 is positioned within the slider channel 24 for extending the blade 14 to an open position and retracting the blade 14 to a closed position. The firing mechanism 32 comprises a slider 34 that has a front leg 36 and a rear leg 38, a front slider arm 40, a rear slider arm 42, and a blade spring 44 that connects them together. The front slider arm 40 extends into the insert channel 30 such that when the blade 14 is in the open position, the blade insert 26 is biased against the front slider arm 40. The rear slider arm 42 also extends into the insert channel 30 such that when the blade 14 is in the closed position, the blade insert 26 is biased against the rear slider arm 42.

A front lock 46 located in the slider channel 26 also extends into the insert channel 30 such that when the blade 14 is in the open position, the blade insert 26 is pressed against the front lock. A rear lock 48 located in the slider channel 26 also extends into the insert channel 30 such that when the blade 14 is in the closed position, the blade insert 26 is pressed against the rear lock 48. A front lock spring 50 biases the front lock 46 towards the front leg 36 and a rear lock spring 52 biases the rear lock 48 towards the rear leg 38. The slider 34 has a nub 54 that fits into an opening 60 in the handle 12 such that the nub extends outside the handle 12. The opening 60 defines the range of movement of the slider 34. The button 16 has a nub opening 62 to receive the nub 54. This allows the button 16 to move the slider 34 between the open position and the closed position for activating the firing mechanism 32.

A friction plate 64 is interposed between the button 16 and the handle 12. The button 16 also has at least one bearing opening 66. At least one bearing 68 is inserted into the at least one bearing opening 66. The bearing 68 supports the button 16 on the friction plate 64. The bearings 68 shown in FIGS. 2-3 are spheres and the bearing openings 66 are sized to receive them.

In the embodiment shown, the button 16 has three bearing openings 66 arranged as shown, but the size, number, and arrangement of bearing openings 66 can be varied. This means that the size, number, and arrangement of bearings 68 may correspondingly be varied.

The bearings 68 may be made of any materials that help bear the movement of the button 16. The preferred material is ceramic, but it could be metal, carbon, or some low-friction material. The friction plate 64 is preferably a steel plate but it could be any other material that can bear the movement of the button 16.

The number of bearings 68 may be varied by the application, but generally, there are as many bearings 68 as there are bearing openings 66 to receive them. The bearing 68 may be pressed into the button or it may be free floating within the bearing openings 66. If necessary, the bearing 68 may be fixed to the bearing openings 66 by pressure, with glue, or some other system or method.

This configuration combining the bearings 68 on the friction plate 64 makes the button 16 to travel over the handle 12 repeatedly with reduced friction and reduced wear on the handle 12 compared to the prior art. Actuating the slider 34 is easier to achieve with this system and the movement of the button is smoother than the prior art.

Figure 4:
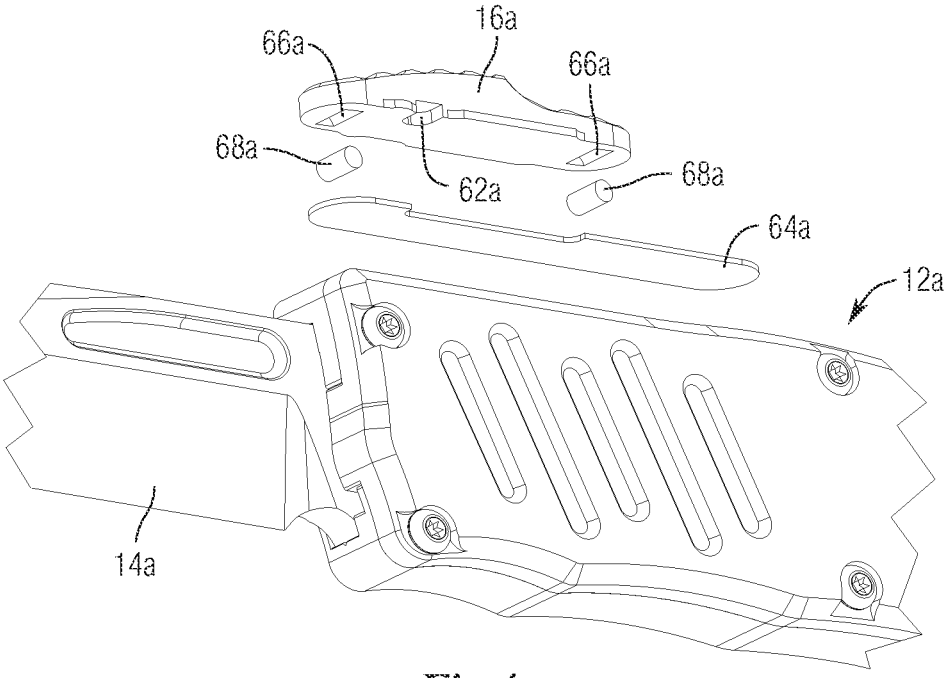
FIG. 4 is a close-up of another embodiment of out-the-front knife in which the bearings are cylindrical.

FIG. 4 shows another embodiment in which the bearings **68*a* are cylinders. The bearing openings 66*a* are sized to receive the bearings 68*a*. Like the earlier embodiment, the size, number, and arrangements of bearings openings 66*a* can be varied. This means that the size, number, and arrangement of bearings 68*a* may correspondingly be varied. The bearings 68*a* may also be free-floating within the bearing openings 66*a*. The bearing 68*a* may instead be fixed to the bearing openings 66*a*** by pressure, with glue, or some other system or method.

Figure 5:
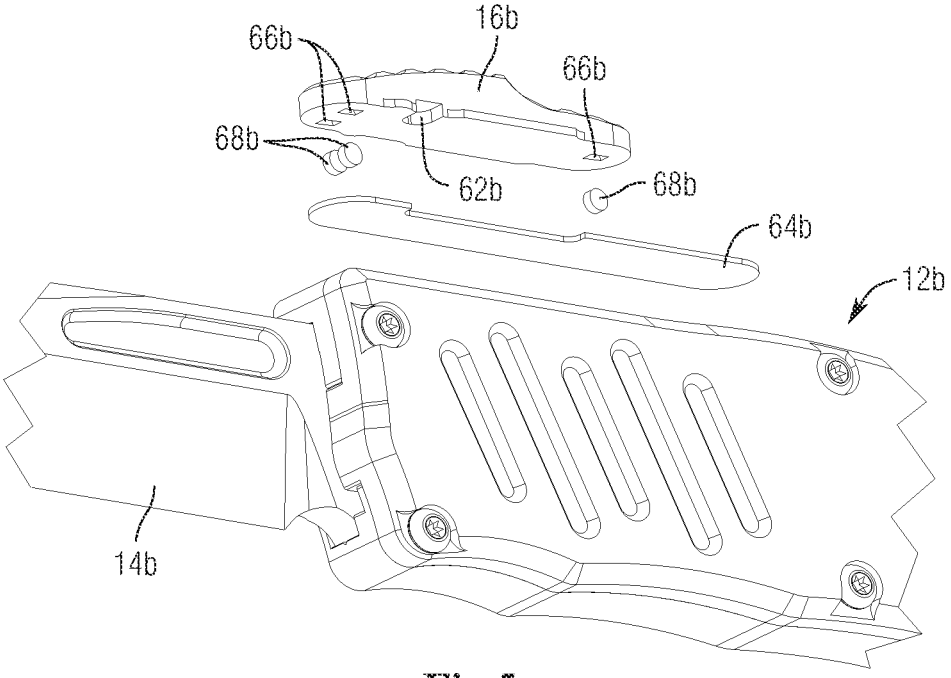
FIG. 5 is a close-up of another embodiment of out-the-front knife in which the bearings are disks.

FIG. 5 shows another embodiment in which the bearings **68*b* are disks. The bearing openings 66*b* are sized to receive the bearings 68*b*. Like the earlier embodiment, the size, number, and arrangements of bearings openings 66*b* can be varied. This means that the size, number, and arrangement of bearings 68*b* may correspondingly be varied. The bearings 68*b* may also be free-floating within the bearing openings 66*b*. The bearing 68*b* may instead be fixed to the bearing openings 66*b*** by pressure, with glue, or some other system or method.

What has not been shown, but is also readily understood is that actual type, number, and size of the bearings used in the button may be varied. For example, the button may use a combination of spheres and cylinders or cylinders and disks.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

The invention claimed is:

1. An out-the-front knife comprising:

a handle having a blade channel, a slider channel, and an opening;

a blade in said blade channel, said blade configured to travel along said blade channel when said blade is retracted, said blade is secured within said handle and is housed completely within said handle and when said blade is extended, said blade is secured within said handle and extends outwardly therefrom;

a firing mechanism in said slider channel configured to extend said blade to an open position and retract said blade to a closed position;

said firing mechanism comprising a slider that has a nub that fits into said opening and extends outside said handle;

a button having a nub opening that receives said nub and at least one bearing opening;

a friction plate placed into an opening of the handle and interposed between said button and said handle; and at least one bearing inserted into said at least one bearing opening, said at least one bearing contacts said friction plate to support said button.

2. The out-the-front knife of claim 1 further comprising said button has three bearing openings of said at least one bearing openings.

3. The out-the-front knife of claim 1 further comprising said at least one bearing is a sphere.

4. The out-the-front knife of claim 1 further comprising said at least one bearing is a cylinder.

5. The out-the-front knife of claim 1 further comprising said at least one bearing is a disk.

6. The out-the-front knife of claim 1 further comprising said at least one bearing is pressed into said at least one bearing opening.

7. The out-the-front knife of claim 1 further comprising said at least one bearing may roll freely within said at least one bearing opening.

8. The out-the-front knife of claim 1 further comprising said at least one bearing is fixed to said at least one bearing opening.

* * * * *